United States Patent [19]

Drewnicki

[11] Patent Number: 5,057,035

[45] Date of Patent: Oct. 15, 1991

[54] TELEPHONE EXTENSION SOCKET

[75] Inventor: Richard Drewnicki, Rutland, England

[73] Assignee: Commtel Consumer Electronics, Plc., England

[21] Appl. No.: 606,818

[22] Filed: Oct. 31, 1990

[30] Foreign Application Priority Data

Nov. 3, 1989 [GB] United Kingdom ..... 8924898

[51] Int. Cl.[5] ..... H01R 11/20; H01R 23/02

[52] U.S. Cl. ..... 439/425; 439/676

[58] Field of Search ..... 439/417, 418, 425, 344, 439/676

[56] References Cited

U.S. PATENT DOCUMENTS

| | | | |
|---|---|---|---|
| 4,315,664 | 2/1982 | Hughes et al. | 439/676 |
| 4,428,636 | 1/1984 | Kam et al. | 439/425 |
| 4,566,749 | 1/1986 | Johnston | 439/425 |
| 4,778,410 | 10/1988 | Tanaka | 439/676 |
| 4,865,561 | 9/1989 | Collier et al. | 439/425 |
| 4,975,078 | 12/1990 | Stroede et al. | 439/417 |

FOREIGN PATENT DOCUMENTS

| | | | |
|---|---|---|---|
| 8906056 | 6/1989 | PCT Int'l Appl. | 439/418 |
| 2110886 | 6/1983 | United Kingdom | 439/418 |
| 2193391A | 2/1988 | United Kingdom . | |

*Primary Examiner*—Gary F. Paumen

*Attorney, Agent, or Firm*—Banner, Birch, McKie & Beckett

[57] ABSTRACT

A telephone extension socket comprising a housing having opposed end portions, an entry formed in one end portion to receive a telephone cable having a plurality of electrically separate wires and a socket formed in the other end portion to receive a multi-contact plug, a plurality of recesses in the housing for the respective reception of the individual wires of the telephone cable, and a plurality of electrical contacts each in the form of a resilient metal strip and each having a first end which projects into a respective recess and which has a formation serving to engage a corresponding wire of the telephone cable, and a second end projecting into the socket end for engagement with a corresponding contact of a multi-contact plug.

8 Claims, 3 Drawing Sheets

TELEPHONE EXTENSION SOCKET

DESCRIPTION

1. Field of the Invention

This invention relates to a telephone extension socket.

1. Background Art

Conventionally a roving or free socket for a telephone extension cable comprise a generally box-like housing having a socket entry for a telephone jack plug on one side and a cable entry on the opposite side, the housing containing a separate moulding which forms a socket cavity and which carries a plurality of electrical contacts. The contacts extend into the cavity to form contact blades and one end of each of the contacts projects from the moulding and is soldered to a printed circuit board, which is also in the housing, the wires of the cable also being connected to the printed circuit board. Such an arrangement is expensive and time consuming to produce, and results in a bulky device.

SUMMARY OF THE INVENTION

According to the invention a telephone extension socket comprises a cable entry end having a plurality of recesses for the respective reception of individual wires of a telephone cable, and a socket end for the reception of a multi-contact plug, a plurality of electrical contacts each in the form of a metal strip and each having a first end which projects into a respective recess and which has a formation serving to engage a corresponding wire of the cable, and a second end projecting into the socket end for engagement with a corresponding contact of a multi-contact plug.

Each formation may serve as an insulation piercing means to pierce the insulation of a corresponding wire.

The socket preferably comprises two plastics mouldings, namely an inner moulding which defines the recesses of the cable entry end, which provides the socket end and which supports the metal strip contacts; and an outer casing which slides over the inner moulding from the cable entry end. The inner moulding preferably has an end wall which serves as the end wall at the socket end of the socket.

The socket preferably has a cable restraint which is operative to restrain any tendency for the cable to be pulled out of the cable entry end. The restraint preferably takes the form of a tongue bendable towards the cable after the latter has been located in the cable entry end. The tongue may be formed integrally in a wall of the inner moulding by the provision in the wall of a line of weakness and a line which can serve as a hinge for the tongue, the line of weakness being ruptured to allow the tongue to be bent about the hinge, so that the tongue engages the cable to restrain the latter.

BRIEF DESCRIPTION OF DRAWINGS

A telephone extension socket according to the invention will now be described by way of example with reference to the accompanying drawings in which.

BEST MODE FOR CARRYING OUT THE INVENTION

Figure 1:
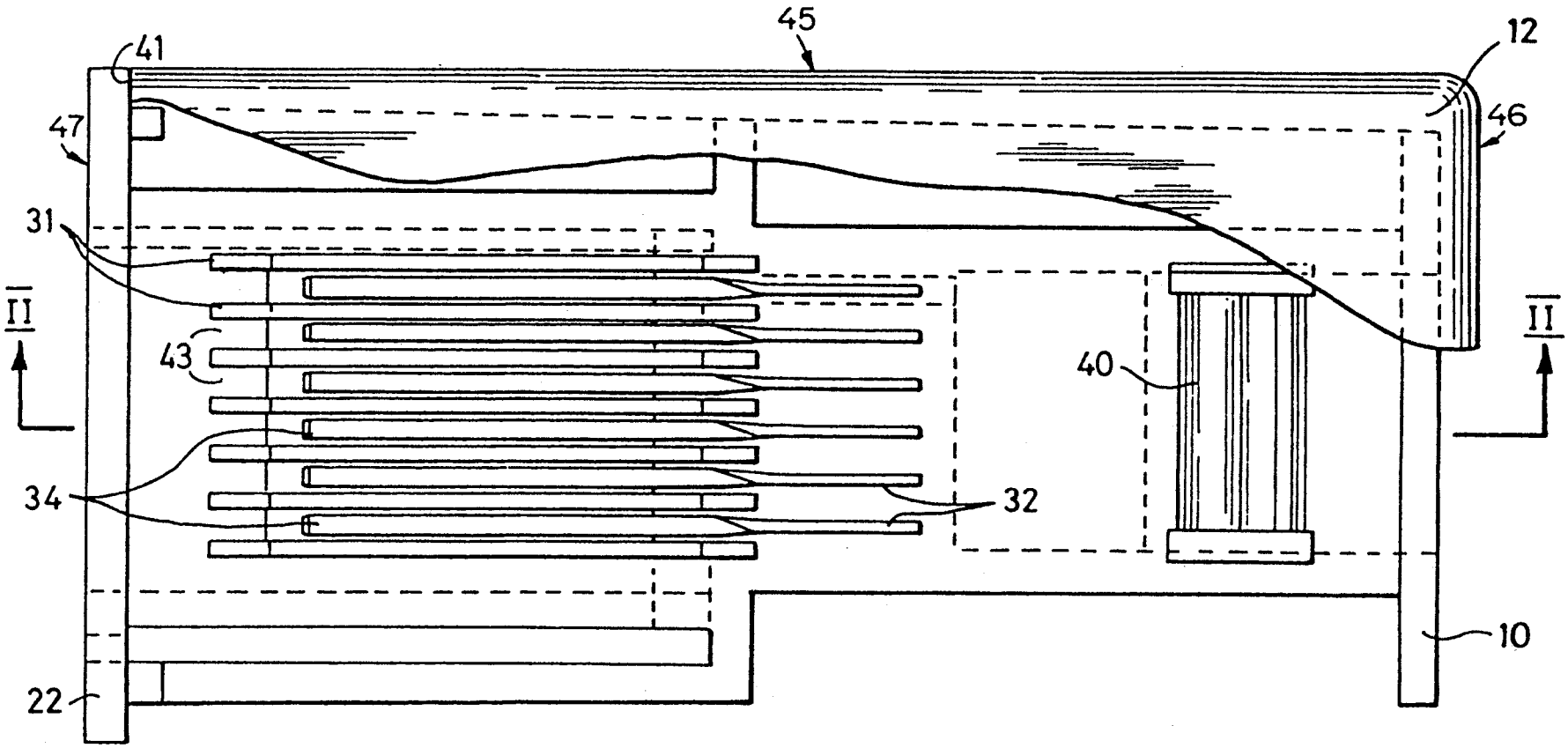
FIG. 1 is a plan view of the socket partially broken away to show internal detail.
Figure 2:
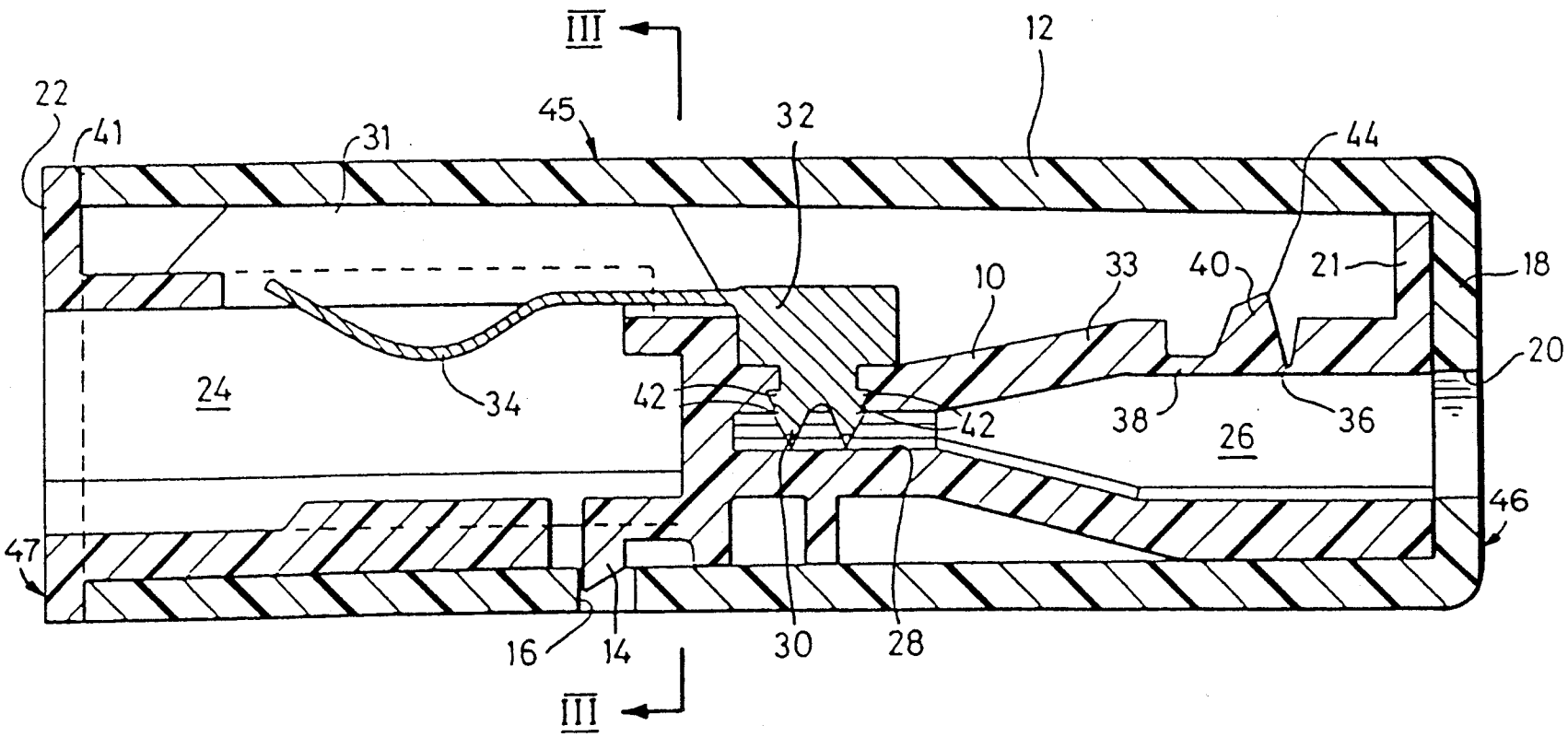
FIG. 2 is a sectional view on the line II—II of FIG. 1.

Referring to the drawings, a telephone extension socket comprises two plastics mouldings, namely an inner moulding 10 and an outer moulding or casing 12 in the form of a generally rectangular box-like structure which slides over the inner moulding 10 from the right-hand end thereof as illustrated in FIGS. 1 and 2. The two mouldings together form a socket housing 45. Location between the inner moulding 10 and outer casing 12 is provided by a detent tab 14 on the inner moulding 10 locating in a recess or slot 16 in a wall of the outer casing 12.

Figure 4:
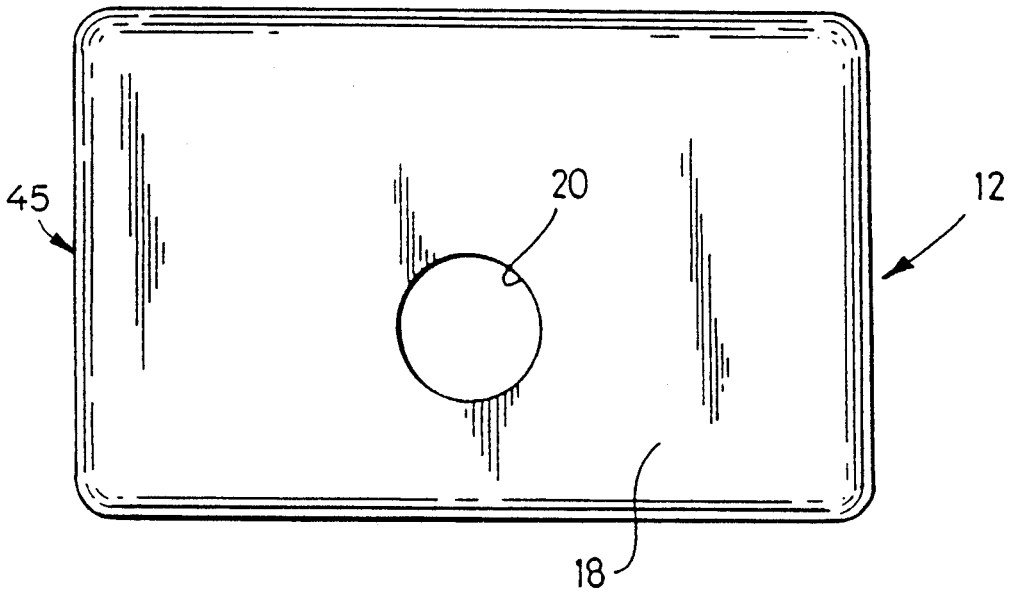
FIG. 4 is an elevation of the right-hand end of the socket as shown in FIGS. 1 and 2.

The socket housing has opposed ends which are respectively a cable entry end 46 and a plug receiving or socket end 47. At the cable entry end of the housing, which is the right-hand end in FIGS. 1 and 2, the outer casing 12 has an end wall 18 formed with a circular cable entry hole 20 (FIG. 4), although it will be understood that the hole 20 will be shaped to correspond to the cross-sectional shape of the cable to be received. At the other end, which is the socket end, the outer casing is formed with an open end through which the inner moulding is inserted. At the socket end of the housing a generally rectangular end wall 22 of the inner moulding 10 has a rectangular opening providing access to the socket 24 for the reception of a multi-contact plug (not shown). As best seen in FIG. 2, the inner moulding 10 is snugly received within the outer casing 12 such that an end 21 of the inner moulding 10 abuts against the end wall 18 of the outer casing 12, and such that the end wall 22 of the inner moulding abuts against the open end 41 of the outer casing 12 to close the open end.

Figure 3:
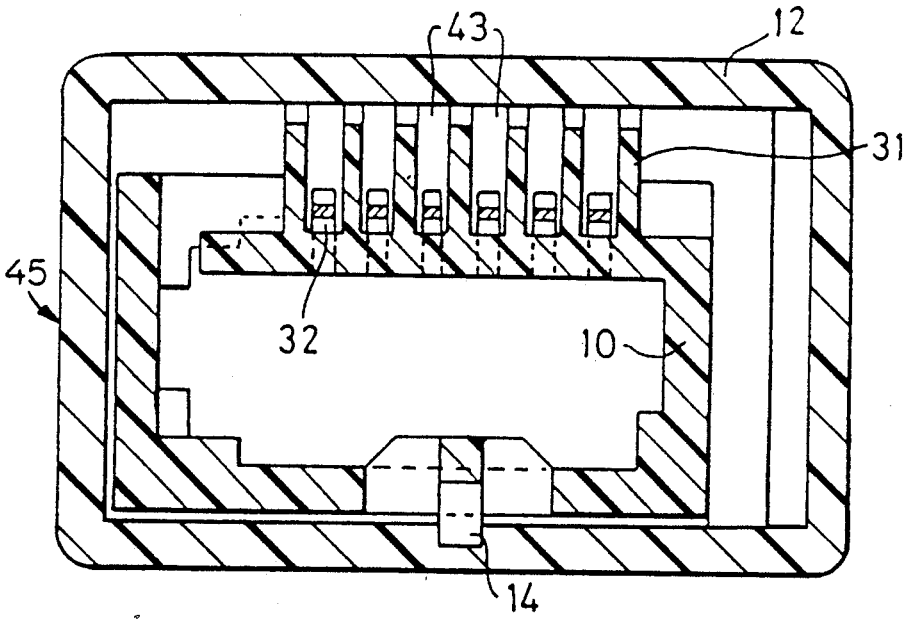
FIG. 3 is a sectional view on the line III—III of FIG. 2.

At the cable entry end of the housing the hole 20 communicates with a cavity 26 in the inner moulding which leads into a plurality of spaced generally cylindrical recesses 28 for the respective reception of individual wires of a telephone cable (not shown). Into each recess 28 projects the double barbed cable piercing blade 30 formed on an electrical contact 32 in the form of a metal strip. The barbs 42 engage the wall of the recess 28 to hold the contacts in position. Each contact 32 extends towards the socket end and projects into the socket 24 where it is in the form of a curved spring contact blade 34. There are six recesses 28 and six contacts 32 which are mounted in the inner moulding 10 in parallel spaced relationship, the contacts being separated by upstanding ribs or flanges 31 as best shown in FIGS. 1 and 3, which define between them grooves or slots 43 in which the contacts are located.

A wall 33 of the inner moulding 10 defining the cavity 26 is formed with a line of weakness 36 and a reduced thickness portion 38 which serves as a hinge for a cable-retaining tongue 40. Downward pressure on the tongue 40 ruptures the plastics along the line of weakness 36, allowing the tongue to be bent downwardly about the hinge 38 into engagement with a cable in the cavity 26, so as to retain the cable in the housing. In this position, the tip 44 of the tongue 40 engages the wall 33 to lock the tongue in position.

The socket is fitted to the end of a telephone cable in the following manner. The outer sheathing of the cable is stripped back to reveal six individual insulated wires. The cable is inserted into the cable entry end of the inner moulding 10 through the cavity 26 (the outer casing 12 not yet being in position on the inner moulding 10) and the six individual wires are located in the respective recesses 28. In this connection it is preferred that the inner moulding is of a transparent plastics material so that the assembler can check visually that the individual wires are correctly positioned. The contacts 32 are then pressed into position so that the insulation piercing blades 30 pierce the insulation on the individual wires and are electrically connected to the wires. The outer case 12 (which has been previously threaded on the cable with the cable passing through the hole 20) is then slid onto the inner moulding 10, the end position being reached when the outer casing 12 abuts the respective end walls of the inner moulding, at which position the detent tab 14 engages with snap action in the slot 16. The socket end of the socket then presents the six blade-like contacts 34 ready for contact with the metal terminals of a multi-contact plug (not shown) which is inserted into the socket 24.

The invention thus provides a simple, inexpensive and small telephone extension socket comprising the minimum number of components and which can be readily assembled.

I claim:

1. A telephone extension socket comprising a housing having opposed end portions, an entry formed in one end portion to receive a telephone cable having a plurality of electrically separate wires and a socket formed in the other end portion to receive a multi-contact plug, a plurality of recesses in the housing for the respective reception of the individual wires of the telephone cable, and a plurality of electrical contacts each in the form of a resilient metal strip and each having a first end which projects into a respective said recess and which has a formation serving to engage a corresponding wire of the telephone cable, and a second end projecting into the socket end for engagement with a corresponding contact of said multi-contact plug, and wherein the socket housing comprises two plastics mouldings which consist of an inner moulding which defines the recesses of the cable entry end portion, which provides the socket end portion, which is formed with supports for the electrical contacts and which has an end which serves as the end wall of the housing at the socket end thereof, and an outer moulding forming a casing which surrounds the majority of the outer surface of the inner moulding and which forms the cable entry end portion.

2. A telephone extension socket according to claim 1, wherein the formation on each electrical contact comprises means to piece the insulation of a corresponding wire.

3. A telephone extension socket according to claim 2, comprising a cable restraint having a tongue movable into engagement with the cable after the latter has been located in position, the tongue being formed integrally in a wall of the inner moulding by the provision in the wall of a reduced thickness portion serving as a hinge for the tongue, sc that the tongue engages the cable to restrain the latter, and means on the tongue for engagement with a portion of the inner moulding to hold the tongue in its cable engaging position.

4. A telephone extension socket according to claim 1 wherein the inner moulding is formed from transparent plastics to enable visual inspection of the wires in their recesses.

5. A telephone extension socket according to claim 1 wherein the outer moulding is formed as a box having an open end.

6. A telephone extension socket according to claim 1 comprising barb means on the first ends of the electrical contacts for engaging the inner moulding for retaining the respective electrical contacts in position.

7. A telephone extension socket according to claim 1 wherein the supports for the electrical contacts comprise a spaced series of flanges which define between them grooves in which the electrical contacts are disposed.

8. A telephone extension socket according to claim 1 comprising detent means on the inner moulding for engaging with a snap-action in a recess in the outer moulding to retain the inner and outer mouldings in mutual engagement.

* * * * *